US012601556B2

(12) United States Patent
Reints et al.

(10) Patent No.: US 12,601,556 B2
(45) Date of Patent: Apr. 14, 2026

(54) FIREARM SUPPRESSOR

(71) Applicant: LMT Advanced Technologies LLC, Davenport, IA (US)

(72) Inventors: Daniel John Reints, Shell Rock, IA (US); Michael Anthony Conger, Davenport, IA (US); Michael Neff, Moline, IL (US)

(73) Assignee: LMT Advanced Technologies LLC, Eldridge, CA (US)

( * ) Notice: Subject to any disclaimer, the term of this patent is extended or adjusted under 35 U.S.C. 154(b) by 0 days.

(21) Appl. No.: 18/631,438

(22) Filed: Apr. 10, 2024

(65) Prior Publication Data

US 2024/0344798 A1 Oct. 17, 2024

Related U.S. Application Data

(60) Provisional application No. 63/496,216, filed on Apr. 14, 2023.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4
See application file for complete search history.

(56) References Cited

U.S. PATENT DOCUMENTS

| | | | | |
|---|---|---|---|---|
| 8,807,005 | B2 | 8/2014 | Moss | |
| 9,052,152 | B2 | 6/2015 | Moss | |
| 9,366,495 | B1 * | 6/2016 | Coppinger | F41A 21/30 |
| 2015/0260472 | A1 * | 9/2015 | Smith | F41A 21/30 89/14.2 |
| 2016/0018179 | A1 * | 1/2016 | Morris | F41A 21/30 181/223 |
| 2016/0209152 | A1 * | 7/2016 | Dueck | F41A 21/30 |
| 2018/0252489 | A1 * | 9/2018 | Parker | F41A 21/30 |
| 2019/0339036 | A1 * | 11/2019 | Edminster | F41A 21/30 |
| 2020/0224989 | A1 * | 7/2020 | Bundy | F41A 21/325 |
| 2020/0232741 | A1 * | 7/2020 | Hood, II | F41A 21/30 |

* cited by examiner

*Primary Examiner* — Bret Hayes
(74) *Attorney, Agent, or Firm* — Woodard, Emhardt, Henry, Reeves & Wagner, LLP

(57) ABSTRACT

A firearm suppressor including a first baffle segment with a cylindrical outer wall and a conical baffle core that defines a central opening, where a longitudinal length of the cylindrical outer wall is longer than a longitudinal length of the conical baffle core; and a second baffle segment comprising a cylindrical outer wall and a conical baffle core that defines a central opening, where a longitudinal length of the cylindrical outer wall is less than a longitudinal length of the conical baffle core.

22 Claims, 18 Drawing Sheets

FIREARM SUPPRESSOR

CROSS-REFERENCE TO RELATED APPLICATIONS

This application claims the benefit of U.S. Provisional Application No. 63/496,216, filed Apr. 14, 2023, which is hereby incorporated by reference.

BACKGROUND

The present disclosure relates to a firearm suppressor that balances the backpressure generated by the suppressor in the firearm while minimizing the sound and flash emitted by the firearm when the firearm is fired.

Firearm suppressors are attached to the muzzle of a firearm barrel to reduce the noise and flash generated by the firearm when it is fired. This is generally accomplished by restricting the rate at which combustion products exit the suppressor. While there are many ways to suppress noise and flash of a firearm, many prior art suppressors greatly reduce the rate at which combustion products are vented from the barrel, which can significantly increase the duration and magnitude of pressure in the barrel after a round is fired. This is generally because many suppressor designs include flow restrictions that increase the time required to empty the barrel of combustion products from an individual firing event. This can be referred to as blowdown rate.

Limiting the increase in the duration and magnitude of pressure in the barrel is important for several reasons. In automatic or semi-automatic firearms, case extraction can occur within milliseconds of firing and some suppressors can increase breech pressure at case extraction by several orders of magnitude compared to the unsuppressed firearms. Insufficient blowdown rate can result in blowback, where hot combustion products vent out of the breach of the barrel when the firearm cycles, sometimes directly into the operator. In addition, insufficient blowdown rate can cause a firearm to cycle more quickly and/or more energetically, with a gas or piston system being energized with higher-pressure gases for longer times and/or pressure in the breach pushing the bolt back through the casing once the bolt is unlocked. This can increase the force and velocity of the bolt during extraction, which increases the cycle rate. This can also increase the velocity that spent casings are ejected from the firearm. Increased cycle rate can result in increased weapon jams due to irregular ejection of spent round casings as well as stripping and feeding inconsistencies from the magazine.

There is also a demand by users of suppressors for suppressors that are capable of being quickly attached and/or removed from the muzzle of the barrel of a firearm (hereafter quick attach suppressor). Many prior art suppressors use threaded attachments between the barrel and suppressor that many users find unsatisfactory due to the time required to attach/remove the suppressor and the need to use specialized tools in some cases. Threaded suppressors can also come unscrewed on their own, especially under high firing situations.

There is a need for suppressors that provide for a rapid blowdown rate while providing adequate sound and flash suppression. There is also a need for a quick attach suppressor that provides for a rapid blowdown rate while providing adequate sound and flash suppression. This can be accomplished through a combination of several design features described below.

DESCRIPTION OF THE SELECTED EMBODIMENTS

Figure 1B:
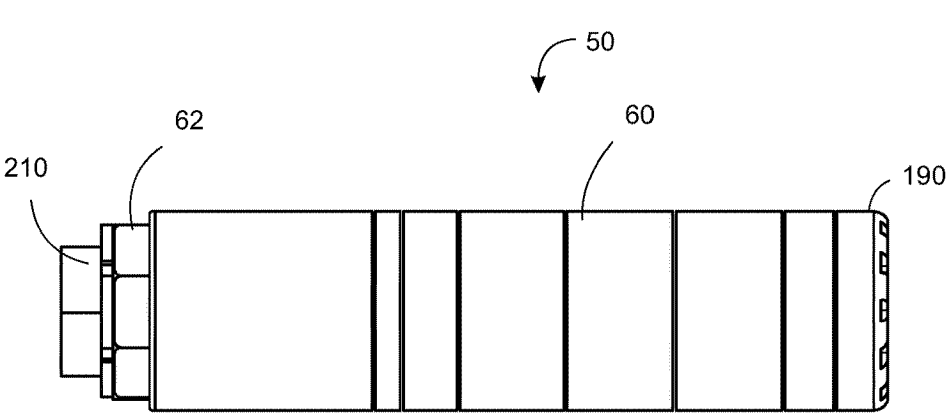
FIG. 1B is a side view of the FIG. 1A firearm suppressor.
Figure 1A:
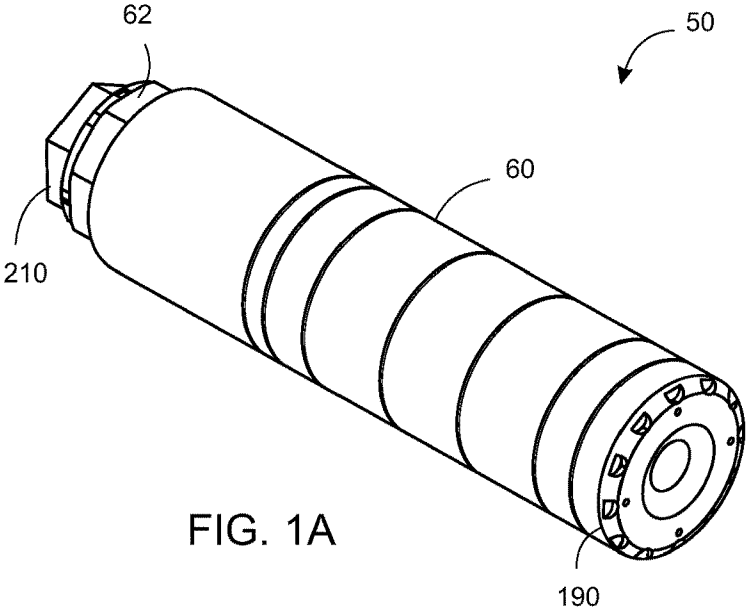
FIG. 1A is a perspective view of a firearm suppressor.
Figure 1D:
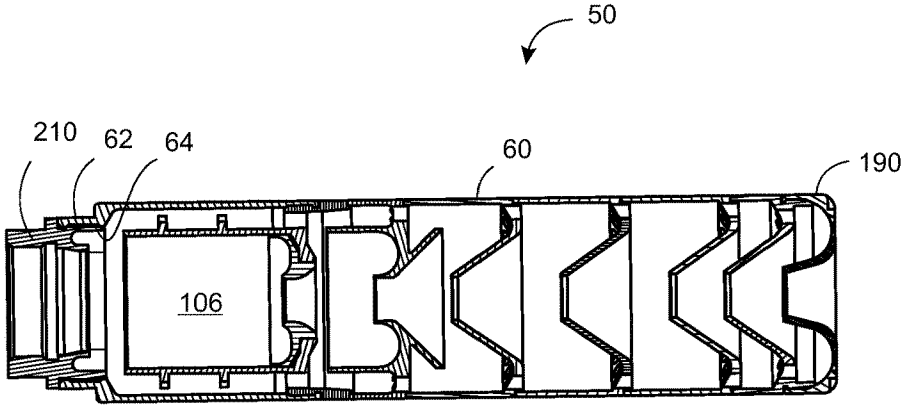
FIG. 1D is a cross sectional view of the FIG. 1A firearm suppressor taken along line 1D-1D in FIG. 1C.
Figure 1C:
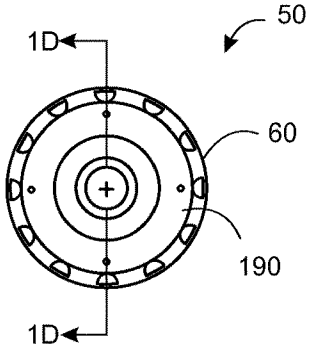
FIG. 1C is an end view of the FIG. 1A firearm suppressor.
Figure 1E:
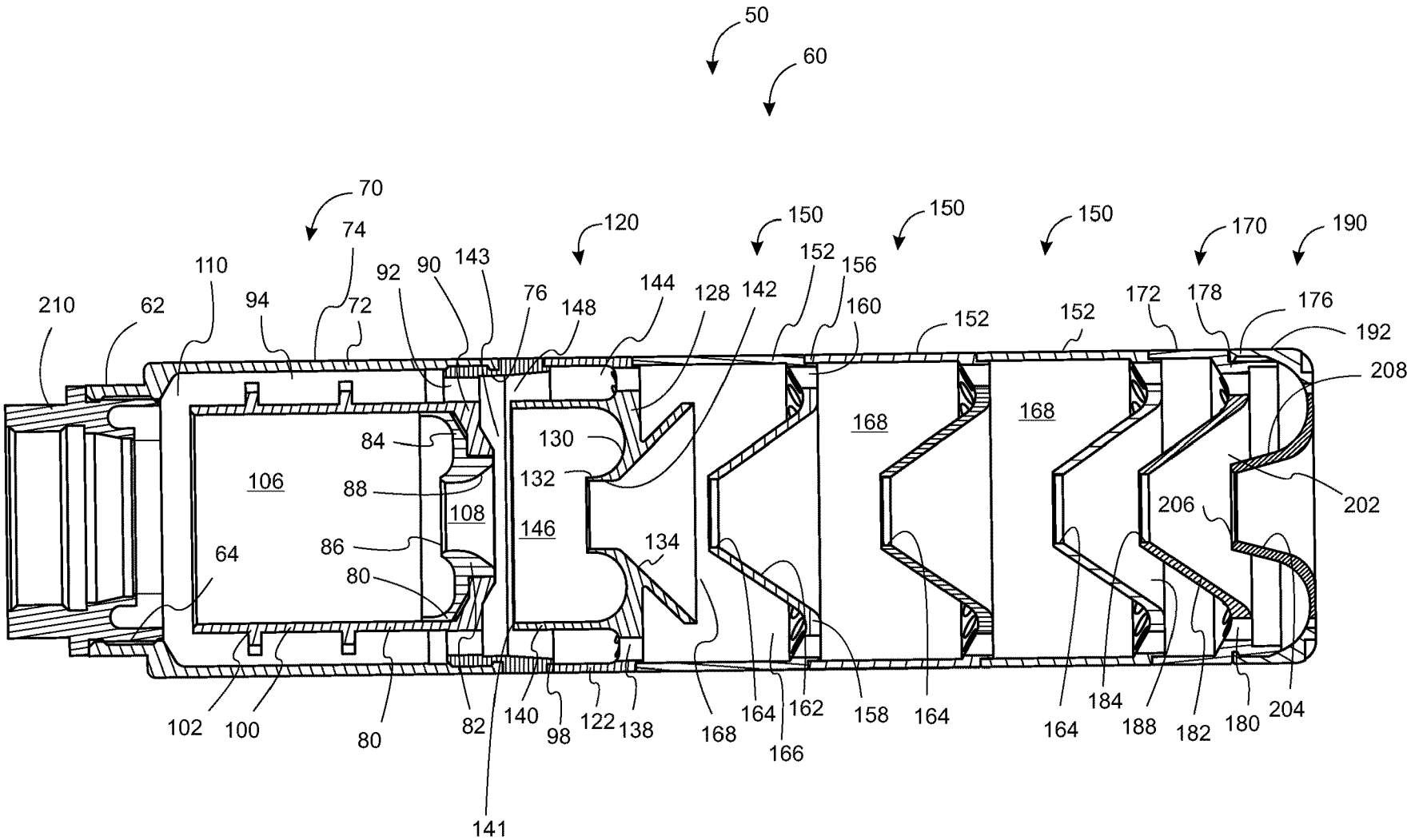
FIG. 1E is an enlarged view of FIG. 1D.

For the purpose of promoting an understanding of the principles of the claimed invention, reference will now be made to the embodiments illustrated in the drawings and specific language will be used to describe the same. It will nevertheless be understood that no limitation of the scope of the claimed invention is thereby intended. Any alterations and further modifications in the described embodiments, and any further applications of the principles of the claimed invention as described herein are contemplated as would normally occur to one skilled in the art to which the claimed invention relates. One embodiment of the claimed invention is shown in great detail, although it will be apparent to those skilled in the relevant art that some features that are not relevant to the present claimed invention may not be shown for the sake of clarity.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "left", "right", "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

Referring to FIGS. 1A-1E, firearm suppressor 50 is illustrated. Firearm Suppressor 50 generally includes suppressor body assembly 60, end cap 190 and adaptor 210. Suppressor body assembly 60 includes baffle 70, one or more baffle assemblies 120, one or more baffle assemblies 150 and one or more baffle assemblies 180. While suppressor body assembly 60 is disclosed with four different baffle assemblies, it should be understood that baffle 70 could include any combination of the disclosed baffle assemblies 70, 12, 150 and 180, including omitting one or more of baffle assemblies 70, 12, 150 and 180. It should also be understood that different, undisclosed, baffle assemblies could be used with one or more of baffle assemblies 70, 12, 150 and 180 to form a suppressor body assembly 60.

Figure 2A:
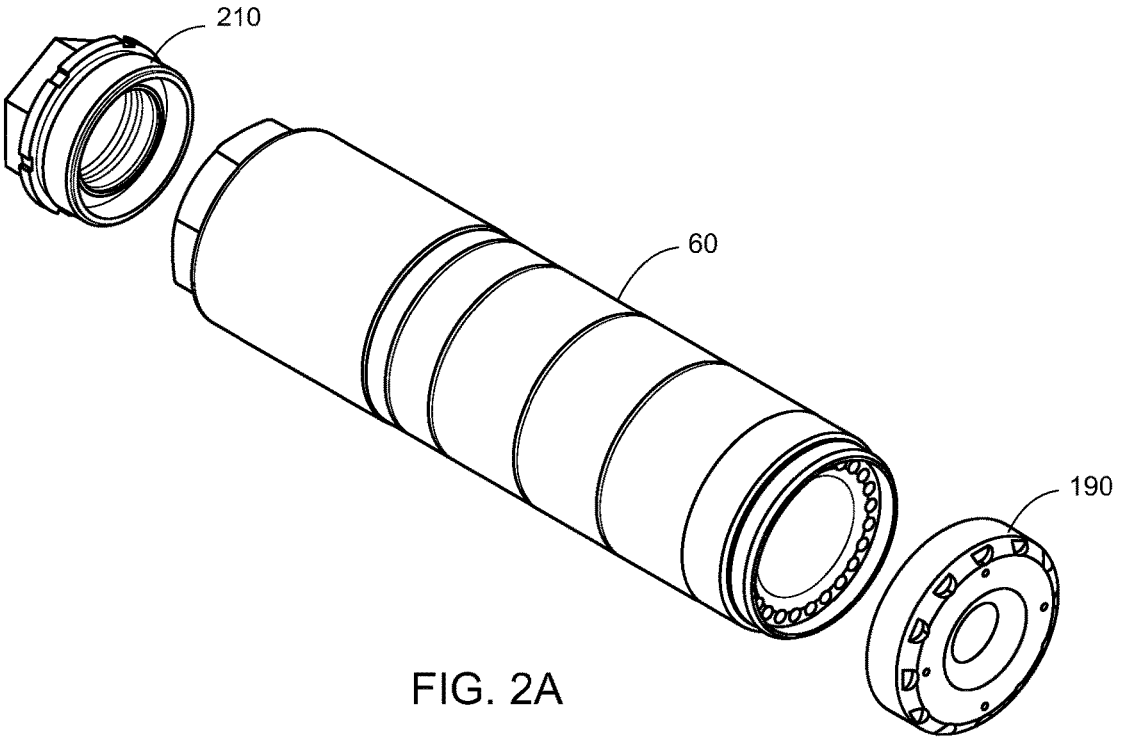
FIG. 2A is a perspective assembly view of the FIG. 1A firearm suppressor.
Figure 2B:
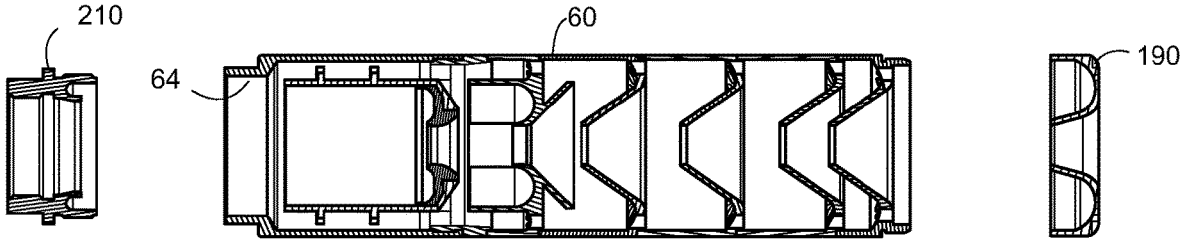
FIG. 2B is a cross sectional view of the FIG. 2A assembly.
Figure 3B:
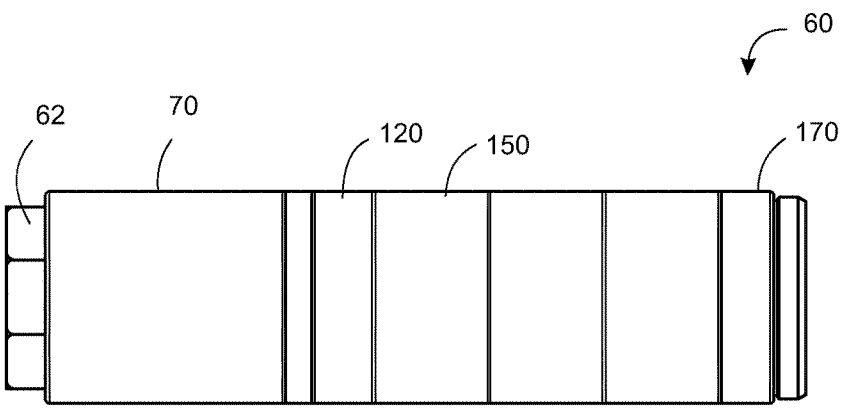
FIG. 3B is a side view of the FIG. 3A suppressor body assembly.
Figure 3D:
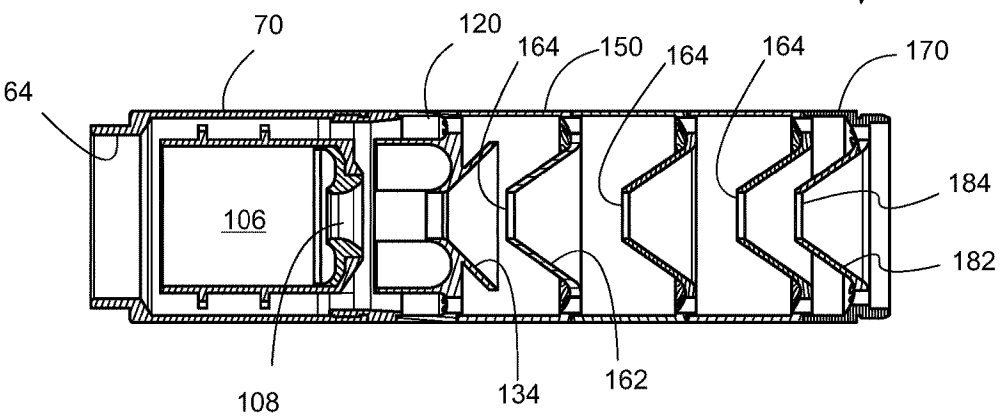
FIG. 3D is a cross sectional view of the FIG. 3A suppressor body assembly taken along line 3D-3D in FIG. 3C.
Figure 3A:
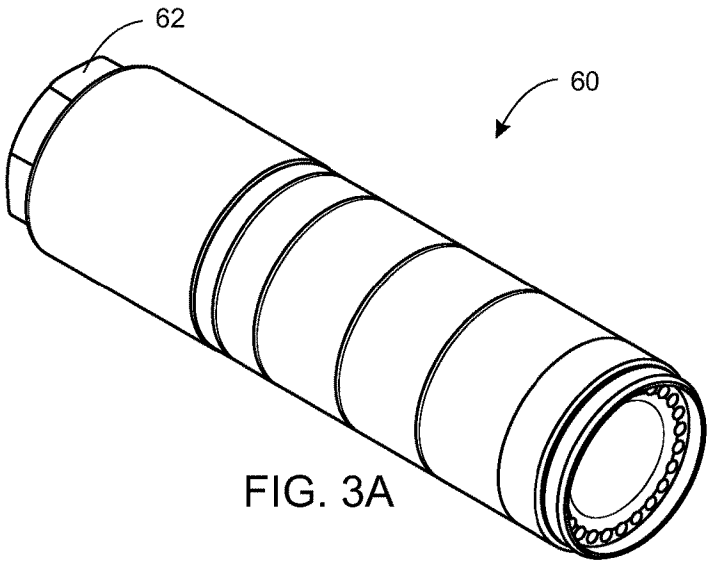
FIG. 3A is a perspective view of a suppressor body assembly, a component of the FIG. 1A firearm suppressor.
Figure 3C:
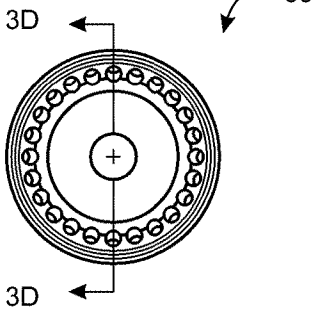
FIG. 3C is an end view of the FIG. 3A suppressor body assembly.
Figure 4A:
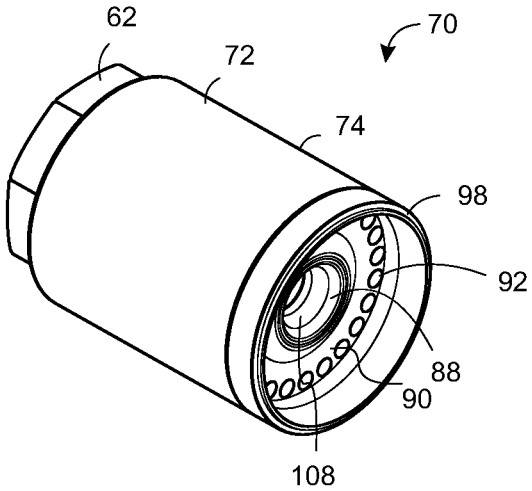
FIG. 4A is a front perspective view of a first baffle assembly, a component of the FIG. 3A suppressor body assembly.
Figure 4B:
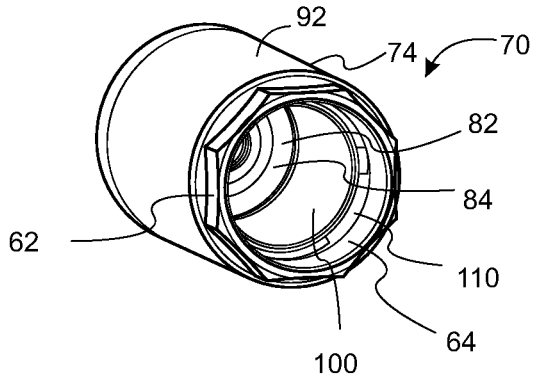
FIG. 4B is a rear perspective view of the FIG. 4A first baffle assembly.
Figure 4C:
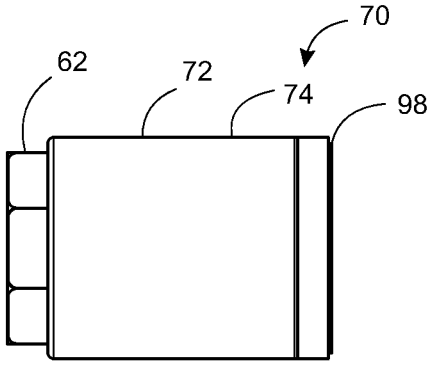
FIG. 4C is a side view of the FIG. 4A first baffle assembly.
Figure 4D:
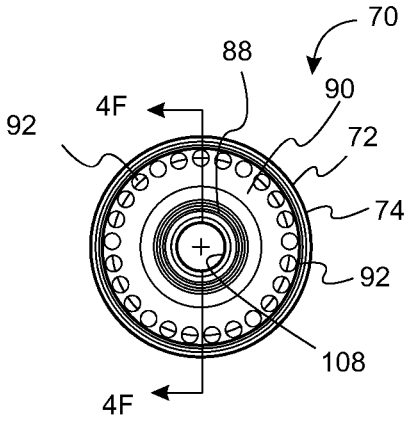
FIG. 4D is an end view of the FIG. 4A first baffle assembly.
Figure 4E:
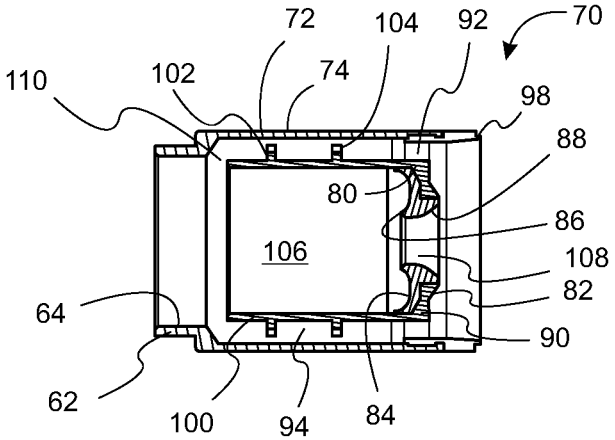
FIG. 4E is a cross sectional view of the FIG. 4A first baffle assembly taken along line 4E-4E in FIG. 4D.
Figure 5A:
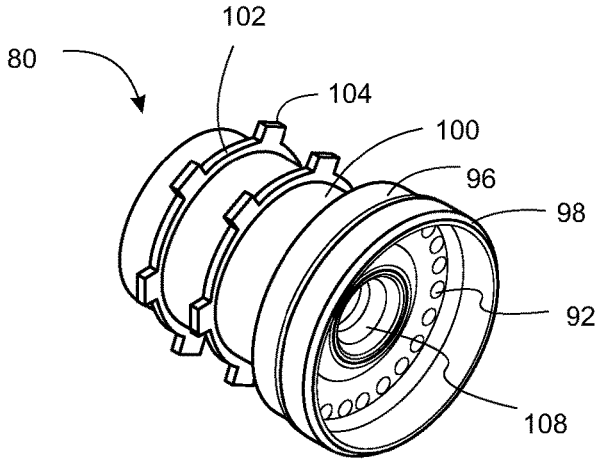
FIG. 5A is a front perspective view of a first baffle core, a component of the FIG. 4A first baffle assembly.
Figure 5B:
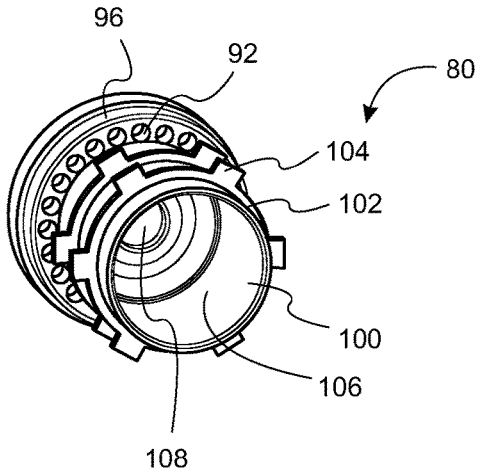
FIG. 5B is a rear perspective view of the FIG. 5A first baffle core.
Figure 5C:
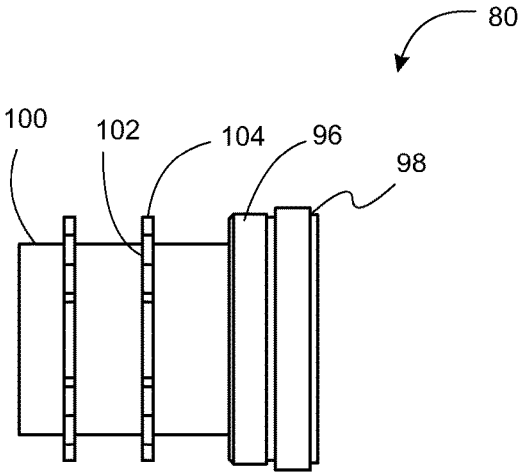
FIG. 5C is a side view of the FIG. 5A first baffle core.
Figure 5D:
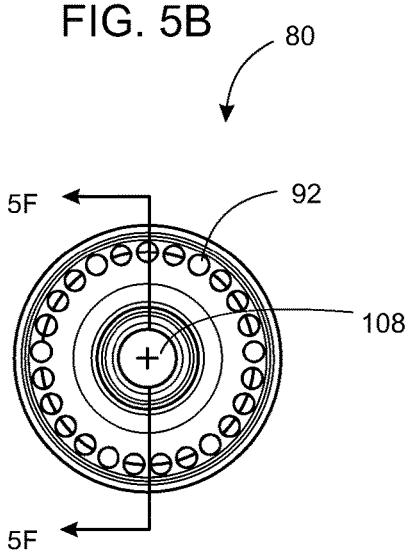
FIG. 5D is an end view of the FIG. 5A first baffle core.
Figure 5E:
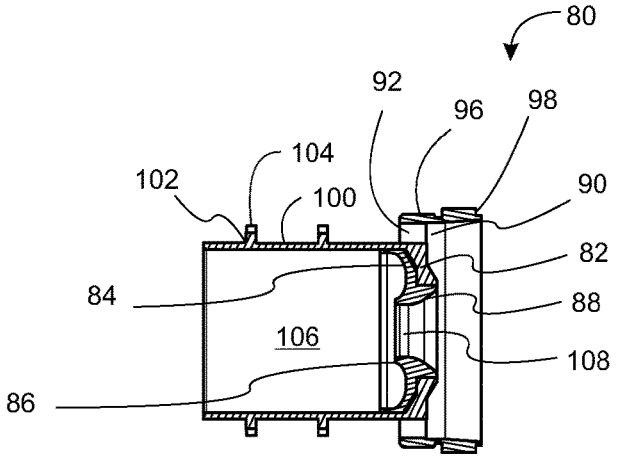
FIG. 5E is a cross sectional view of the FIG. 5A first baffle core taken along line 5E-5E in FIG. 5D.
Figure 6A:
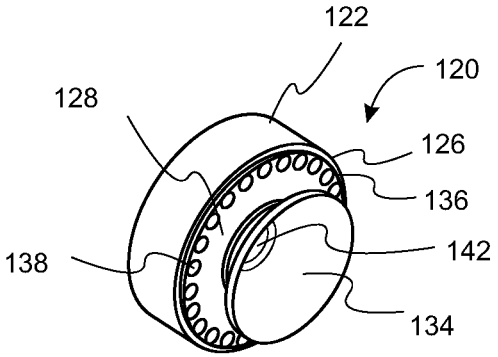
FIG. 6A is a front perspective view of a second baffle, a component of the FIG. 4A first baffle assembly.
Figure 6B:
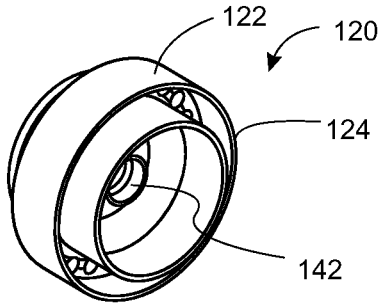
FIG. 6B is a rear perspective view of the FIG. 6A second baffle.
Figure 6C:
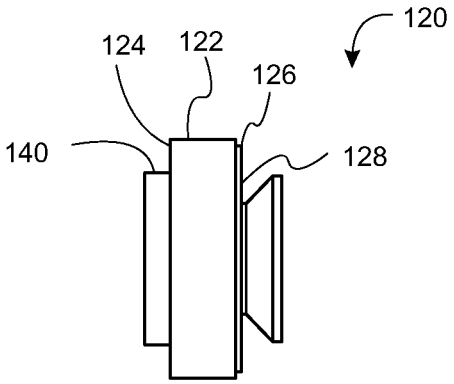
FIG. 6C is a side view of the FIG. 6A second baffle.
Figure 6D:
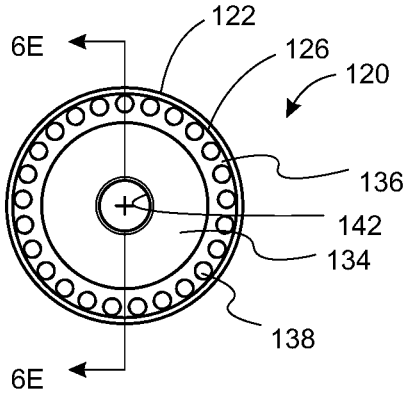
FIG. 6D is an end view of the FIG. 6A second baffle.
Figure 6E:
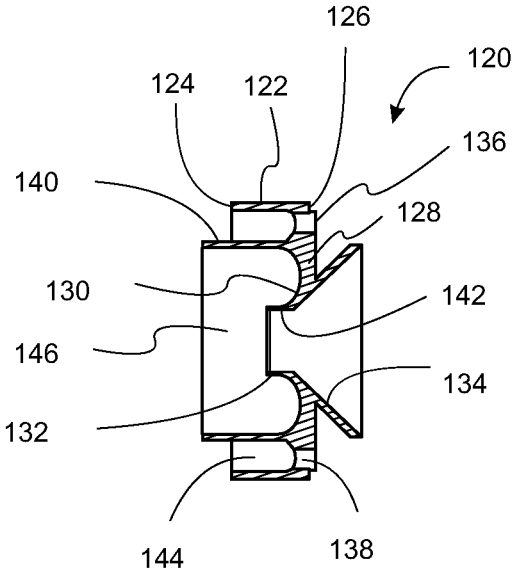
FIG. 6E is a cross sectional view of the FIG. 6A second baffle taken along line 6E-6E in FIG. 6D.
Figure 7A:
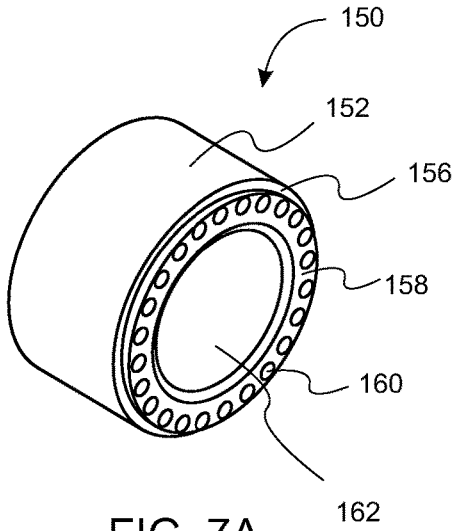
FIG. 7A is a front perspective view of a third baffle, a component of the FIG. 4A first baffle assembly.
Figure 7B:
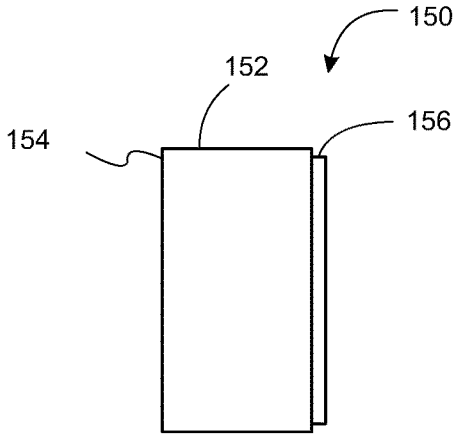
FIG. 7B is a side view of the FIG. 7A third baffle.
Figure 7C:
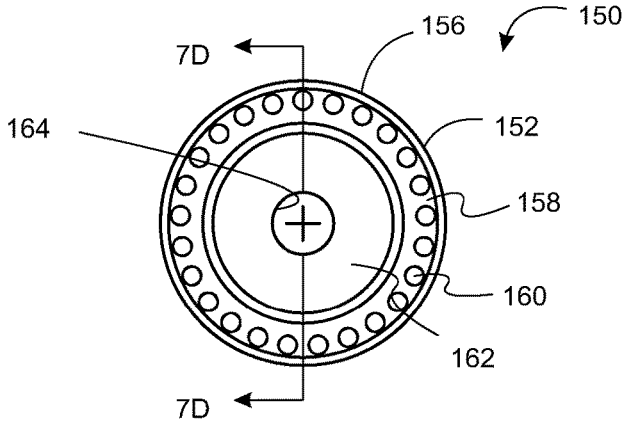
FIG. 7C is an end view of the FIG. 7A third baffle.
Figure 7D:
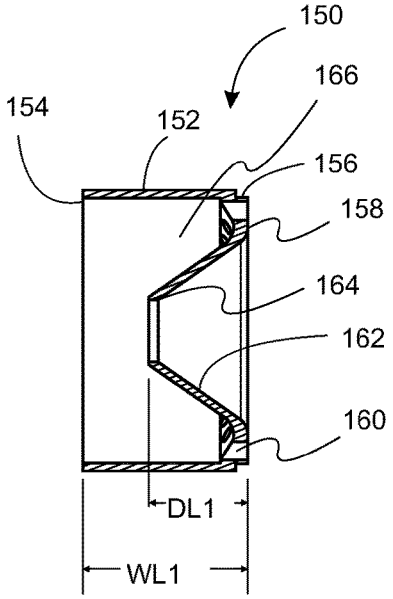
FIG. 7D is a cross sectional view of the FIG. 7A third baffle taken along line 7D-7D in FIG. 7C.
Figure 8A:
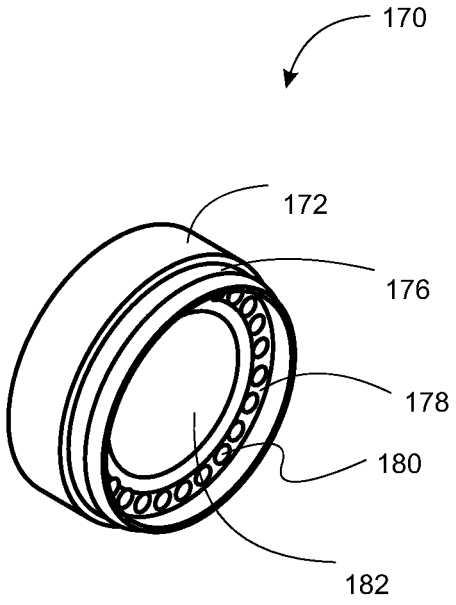
FIG. 8A is a front perspective view of a fourth baffle, a component of the FIG. 4A first baffle assembly.
Figure 8B:
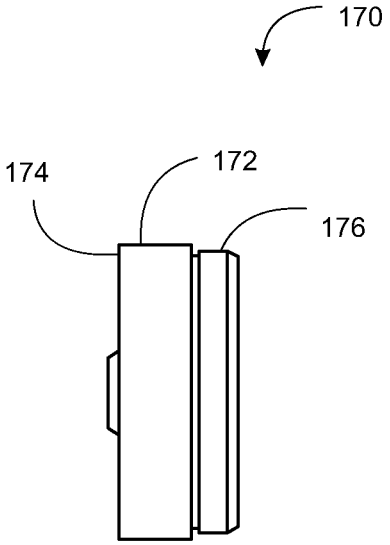
FIG. 8B is a side view of the FIG. 8A fourth baffle.
Figure 8C:
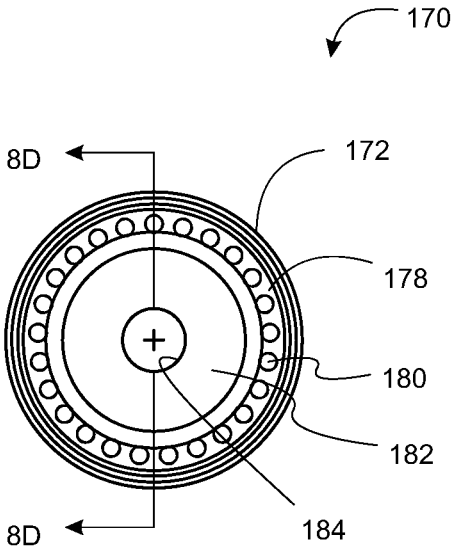
FIG. 8C is an end view of the FIG. 8A fourth baffle.
Figure 8D:
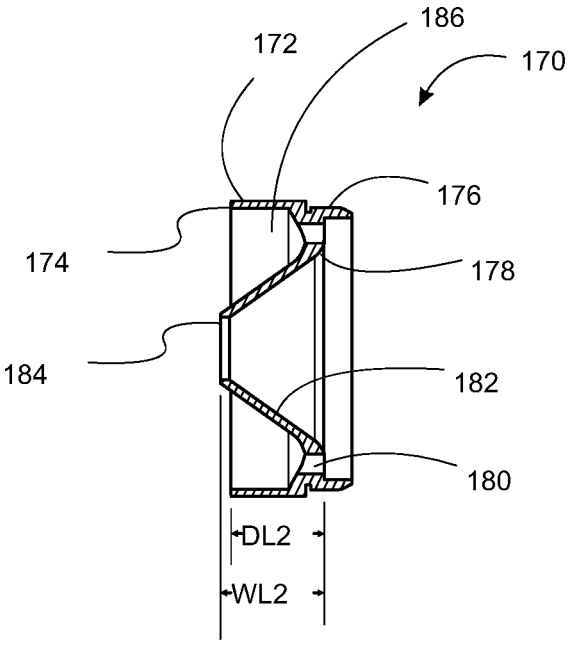
FIG. 8D is a cross-sectional view of the FIG. 8A fourth baffle taken along line 8D-8D in FIG. 8C.
Figure 9A:
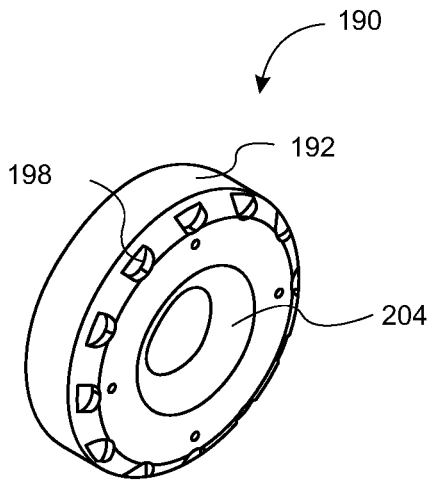
FIG. 9A is a front perspective view of an end cap, a component of the FIG. 4A first baffle assembly.
Figure 9B:
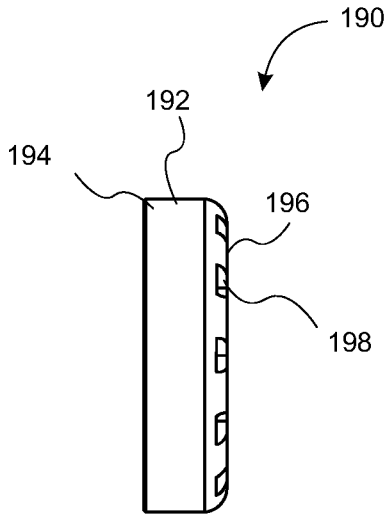
FIG. 9B is a side view of the FIG. 9A end cap.
Figure 9C:
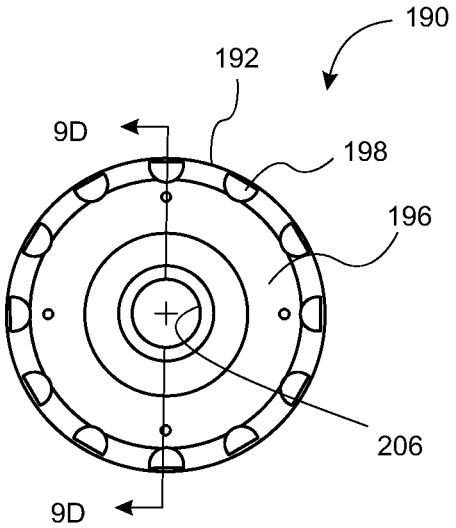
FIG. 9C is an end view of the FIG. 9A end cap.
Figure 9D:
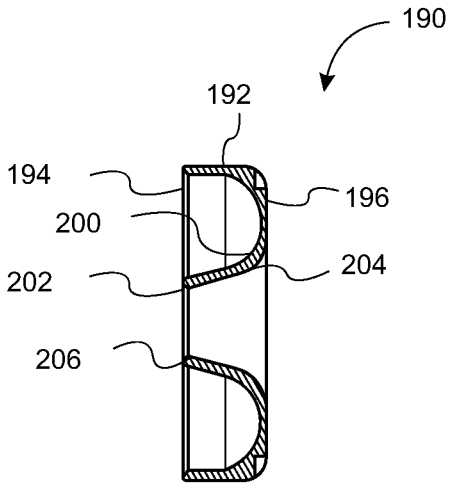
FIG. 9D is a cross sectional view of the FIG. 9A end cap taken along line 9D-9D in FIG. 9C.
Figure 10A:
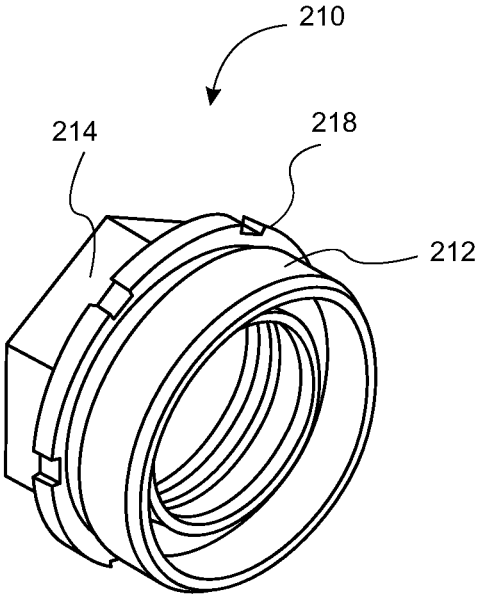
FIG. 10A is a front perspective view of an adaptor, a component of the FIG. 4A first baffle assembly.
Figure 10B:
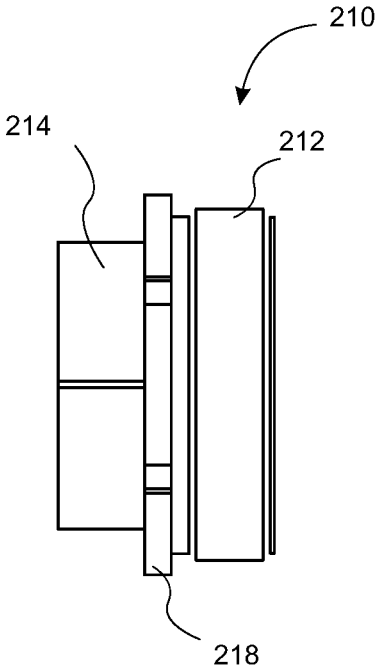
FIG. 10B is a side view of the FIG. 10A adaptor.
Figure 10C:
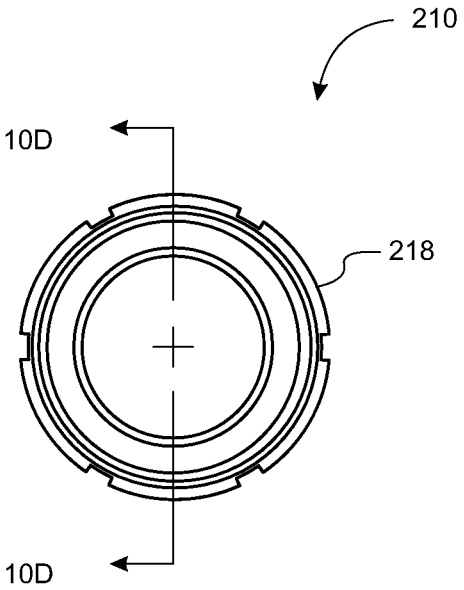
FIG. 10C is an end view of the FIG. 10A adaptor.
Figure 10D:
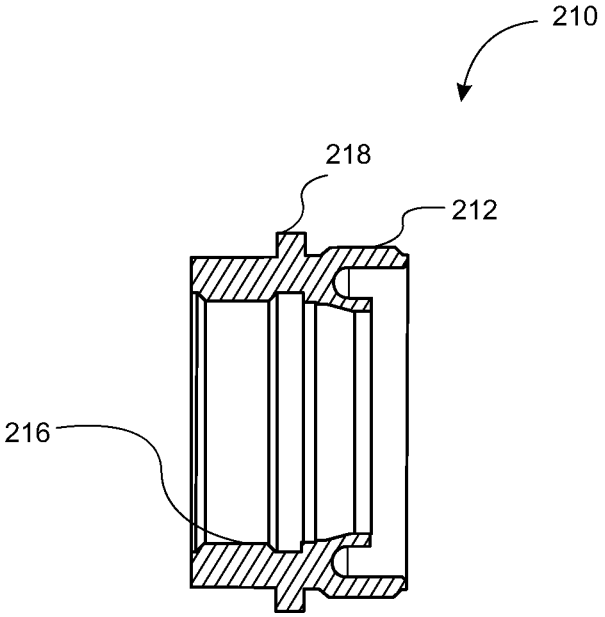
FIG. 10D is a cross sectional view of the FIG. 10A adaptor taken along line 10D-10D in FIG. 10C.
Figure 11B:
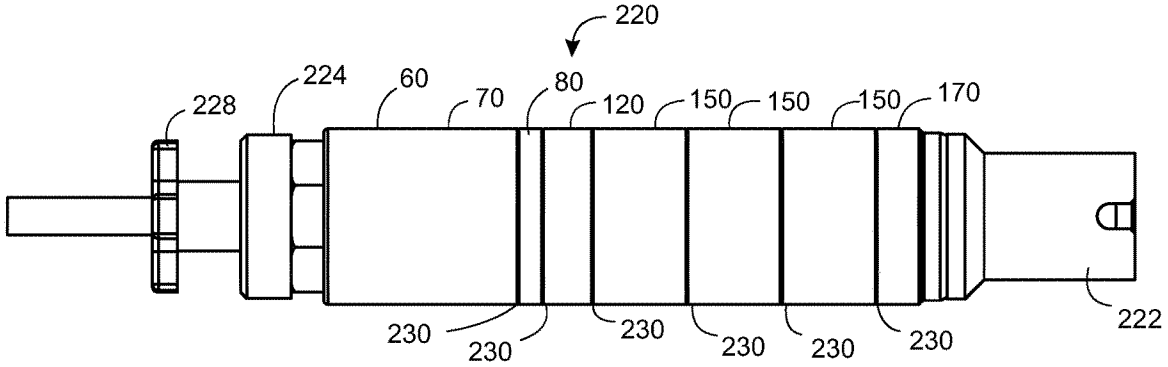
FIG. 11B is a side view of the FIG. 11A assembly.
Figure 11A:
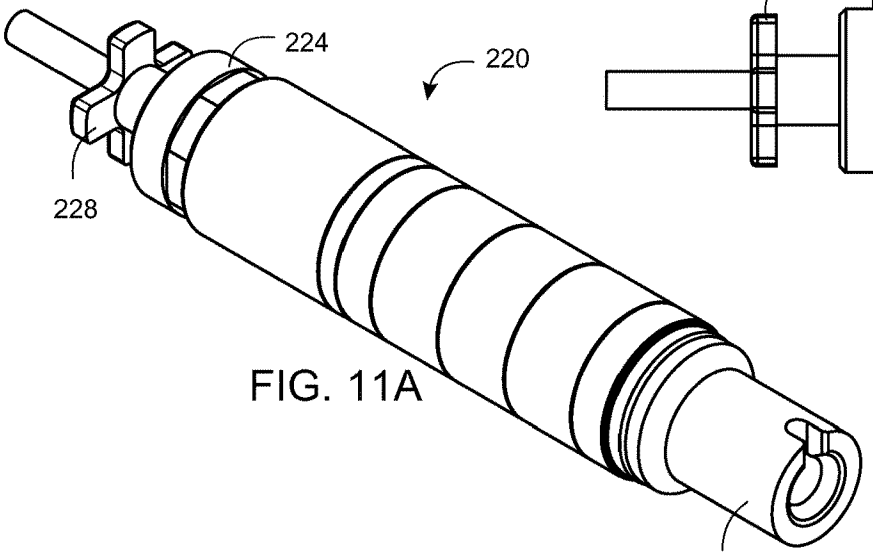
FIG. 11A is a perspective view of the FIG. 3A suppressor body assembly in an assembly jig.
Figure 11D:
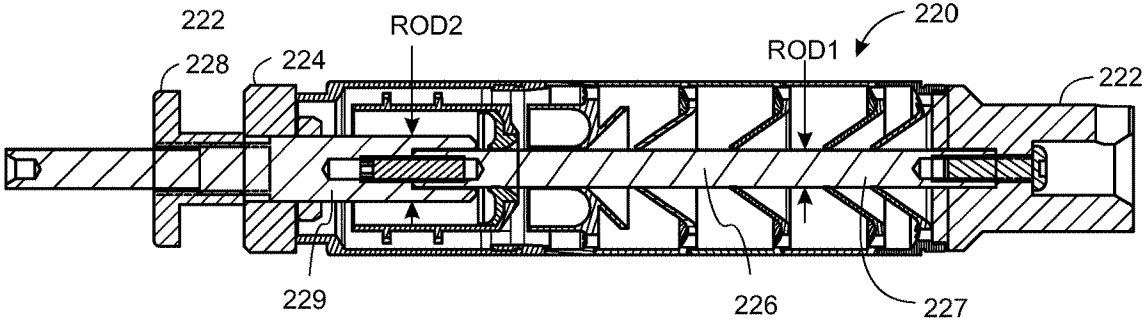
FIG. 11D is a cross sectional view of the FIG. 11A assembly taken along line 11D-11D in FIG. 11C.
Figure 11C:
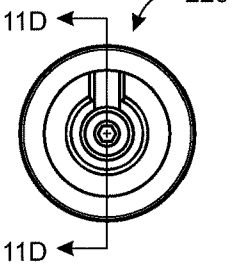
FIG. 11C is an end view of the FIG. 11A assembly.

Referring to FIGS. 2A-2B, firearm suppressor 50 is shown as an assembly view including suppressor body assembly 60, end cap 190 and adaptor 210. Adaptor 210 can be attached to suppressor body assembly 60 by a variety of methods, including, but not limited to snap fit, friction fit, welding or a threaded connection. End cap 190 can be attached to suppressor body assembly 60 by a variety of methods, including, but not limited to snap fit, welding or a threaded connection.

Referring to FIGS. 3A-3D, suppressor body assembly 60 is illustrated. Suppressor body assembly 60, as illustrated, includes one baffle 70, one baffle assembly 120, three baffle assemblies 150 and one baffle assembly 180. This configuration is an example of one configuration of the various baffle assemblies. As discussed above, different configurations can be used.

Referring to FIGS. 1A-1E and 4A-4E, baffle 70 is shown. Baffle 70 generally includes outer tube 72 and baffle core 80. Outer tube 72 generally includes outer wall 74, mount 76, mount 64 and wrenching surface 62. Baffle core 80 generally includes wall 82 having radiused surface 84, rim 86 and conical outlet 88, perforated shoulder 90 having a plurality of ports 92 positioned around perforated shoulder 90 with rim 96 and shoulder 98. Baffle core 80 also includes wall 100 with ribs 102 and protrusions 104. Walls 82 and 100 generally define blast chamber 106. Wall 82 defines central opening 108. The space between wall 100 and outer wall 74 defines opening 110 and passage 94.

Referring to FIGS. 5A-5E, baffle core 80 is shown in isolated detail. Baffle 70 is assembled with mount 76 on outer tube 72 overlapping rim 96 on baffle core 80. Outer tube 72 can be attached to baffle core 80 by welding, a threaded connection or the like.

Referring to FIGS. 1A-1E and 6A-6E, baffle assembly 120 is shown. Baffle assembly 120 generally includes outer wall 122, mount 124, rim 126, wall 128 defining radiused surface 130, edge 132 and conical outlet 134, perforated shoulder 136 with a plurality of ports 138 and inner wall 140. Inner wall 140 defines rim 141. Wall 128 defines central opening 142. The space between inner wall 140 and baffle wall 82 defines lateral passage 143. The space between outer wall 122 and inner wall 140 defines outer passage 144. The space within inner wall 140 defines inner passage 146. The space between inner wall 140 and the preceding baffle defines annular opening 148.

Referring to FIGS. 1A-1E and 7A-7E, baffle assembly 150 is shown. Baffle assembly 150 generally includes outer wall 152, mount 154, rim 156, perforated shoulder 158 with a plurality of ports 160 and conical diffuser 162. Outer wall 152 has a length WL1. Conical diffuser 162 has a longitudinal length DL1 that is shorter than length WL1. Conical diffuser 162 defines central opening 164. Ports 160 define outer passage 166. The space between outer wall 152 and conical diffuser 162 defines annular opening 168.

Referring to FIGS. 1A-1E and 8A-8E, baffle assembly 170 is shown. Baffle assembly 170 generally includes outer wall 172, mount 174, rim 176, perforated shoulder 178 with a plurality of ports 180 and conical diffuser 182. Outer wall 172 has a length WL2. Conical diffuser 182 has a longitudinal length DL2 that is longer than length WL2. Conical diffuser 182 defines central opening 184. Ports 180 define outer passage 186. The space between outer wall 172 and conical diffuser 182 defines annular opening 188.

Referring to FIGS. 1A-1E and 9A-9D, end cap 190 is shown. End cap 190 generally includes outer wall 192 that includes shoulder 194, end wall 196, a plurality of ports 198, radiused surface 200, edge 202, conical outlet 204 and radiused surface 208. Edge 202 defines central port 206. Radiused surface 200 extends between the inside of outer wall 192, end wall 196 and a portion of conical outlet 204. Shoulder 194 is adapted to be mounted on one of rims 176 or 156. Shoulder 194 can be configured to be snapped onto one of rims 176 or 156, permitting manual attachment and removal of end cap 190 without tools. Ports 198 are optionally included in end cap 190. Including ports 198 generally results in increased blowdown rates but typically increases emission of sound and flash when the weapon is fired. Removing or reducing the size and/or number of ports 198 should result in reductions in emitted sound and flash and a corresponding decrease in blowdown rate. End cap 190 can be configured to be easily removable and replaceable, potentially allowing some customization of the characteristics of the suppressor by just changing end cap 190.

Referring to FIGS. 1A-1E and 10A-10D, adaptor 210 is shown. Adaptor 210 generally includes rim 212, wrenching surface 214, mount 216 and shoulder 218. Rim 212 is configured to attach to mount 64 on suppressor body assembly 60. Rim 212 can be removable attached to mount 64 or it can be permanently attached to mount 64. By way of example, rim 212 and mount 64 may be threadingly engaged with each other. Mount 216 is configured to receive a flash hider or muzzle break as described below. Shoulder 218 is configured to abut outer tube 72 when rim 212 is fully attached to mount 64. As described in greater detail below, different adaptors can be used to accommodate different barrel configurations, including, but not limited to, different flash hiders, different muzzle breaks, an direct barrel mounting such as with a threaded connection between the adaptor and the barrel.

Referring to FIGS. 11A-11D, assembly jig 220 is shown. Assembly jig 220 generally includes crown 222, base 224, rod 226 and handle 228. Handle 229 is threadingly engaged with rod 226 to generate a clamping force between crown 222 and base 224. Rod 226 has rod portion 227 having rod outer diameter ROD1 and rod portion 229 having rod outer diameter ROD2. Rod outer diameter ROD1 is configured to have a close fit with central opening 108, central opening 142, central opening 164 and central opening 184. Rod portions 227 and 229, in the illustrated embodiment, are coupled together with a threaded connection. However, it should be understood that rod portions 227 and 229 could optionally be unitarily constructed from a single piece. It should also be understood that, while the illustrated embodiment of rod portions 227 and 229 have different outer diameters, they could optionally have the same outer diameter. Assembly jig 220 is configured to stack and clamp stacks of baffle assemblies 70, 120, 150 and 170 in an aligned configuration for welding, for example, laser welding, along joints 230 between adjacent baffle assemblies. The close fit between rod 226 and central opening 108, central opening 142, central opening 164 and central opening 184 may provide alignment of central openings 108, 142, 164 and 184 after welding is completed. Alignment of central openings 108, 142, 164 and 184 is important because central openings 108, 142, 164 and 184 define a passageway through suppressor 50 that projectiles pass through.

Referring to FIGS. 12A-12D and 13A-13D, flash hider 240 is illustrated both by itself and mounted using a quick connection mounting to suppressor 50. Adaptor 210 on suppressor 50 is configured to receive flash hider 240. Flash hider 240 is configured to be mounted on the barrel muzzle, for example, with a threaded connection.

Referring to FIGS. 14A-14D and 15A-15D, flash hider 260 is illustrated both by itself and mounted using a quick connection mounting to suppressor 52. Suppressor 52 is similar to suppressor 50 but suppressor 52 includes adaptor 250 instead of adaptor 210. Adaptor 250 on suppressor 52 is configured to receive flash hider 260. Flash hider 260 is configured to be mounted on the barrel muzzle, for example, with a threaded connection.

Referring to FIGS. 16A-16D and 17A-17D, muzzle break 280 is illustrated both by itself and mounted using a quick connection mounting to suppressor 54. Suppressor 54 is similar to suppressor 50 but suppressor 54 includes adaptor 270 instead of adaptor 210. Adaptor 270 on suppressor 54 is configured to receive muzzle break 280. Muzzle break 280 is configured to be mounted on the barrel muzzle, for example, with a threaded connection.

Baffle core 80, and specifically blast chamber 106 are configured to receive a variety of differently sized flash hiders or muzzle breaks, for example, flash hiders 240 or 260 or muzzle break 280 by using a different adaptor, for example, one of adaptors 210, 250 or 270, as non-limiting examples, while providing space between flash hiders 240 or 260 or muzzle break 280 and rim 86 of baffle core 80 as well as space between flash hiders 240 or 260 or muzzle break 280 and inner wall 100 of baffle core 80.

Firearm suppressor 50 (and suppressors 52 and 54) provide several circuitous gas flow paths that delay emission of gases (and sound and light) while not excessively restricting the flow of the emitted gases. In this regard, there is always a direct passageway between the barrel and central port 206 (as there must be a passageway for the projectile), however, the configuration of firearm suppressor 50 (and suppressors 52 and 54) diverts much of the emitted gases through longer, less direct, routes to central port 206, including routes that are lateral relative to the longitudinal axis.

Figure 12B:
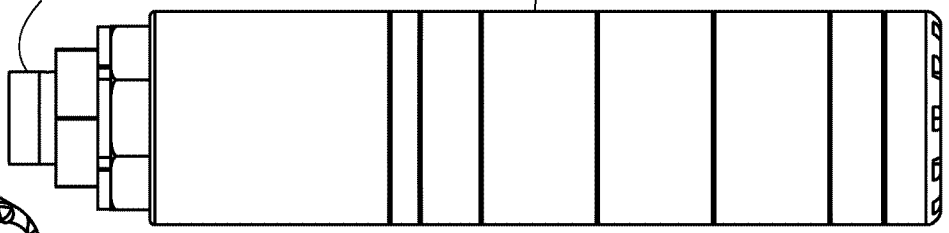
FIG. 12B is a side view of the FIG. 12A assembly.
Figure 12A:
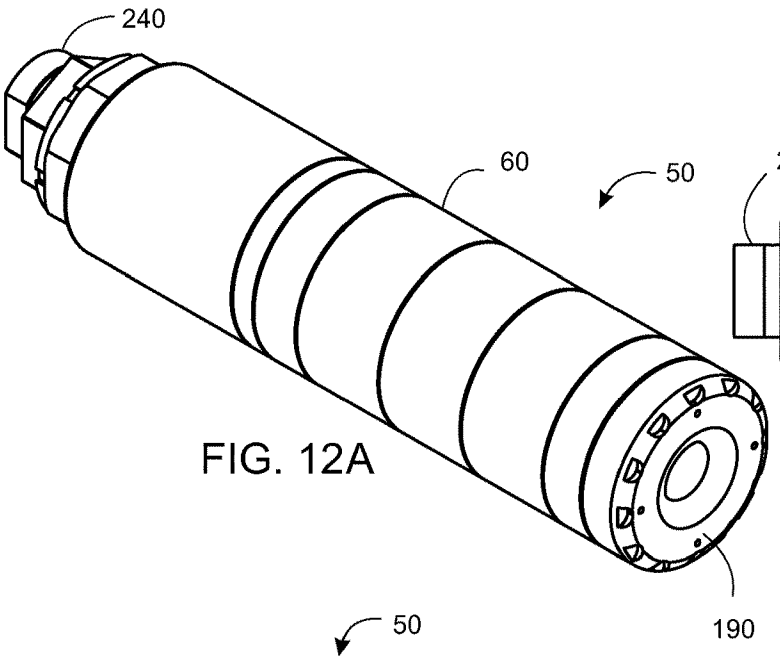
FIG. 12A is a perspective view of the FIG. 3A suppressor body assembly assembled with a first adaptor and a first flash hider.
Figure 12D:
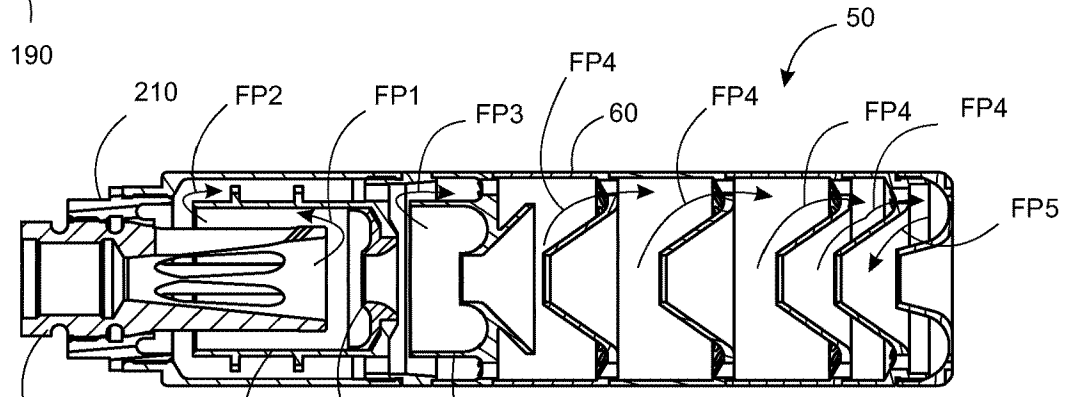
FIG. 12D is a cross sectional view of the FIG. 12A assembly taken along line 12D-12D in FIG. 12C.
Figure 12C:
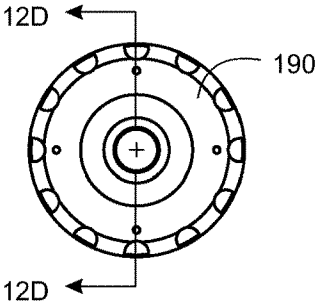
FIG. 12C is an end view of the FIG. 12A assembly.
Figure 13A:
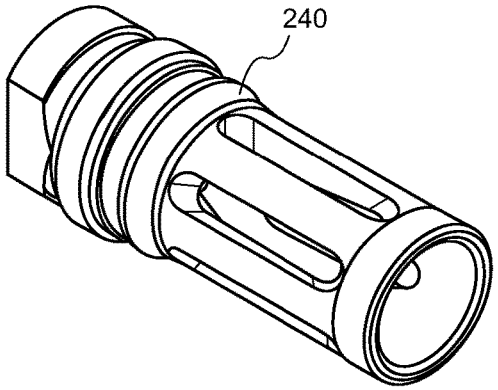
FIG. 13A is a perspective view of the FIG. 12A flash hider.
Figure 13B:
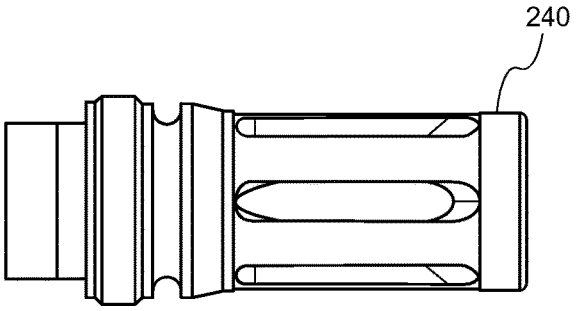
FIG. 13B is a side view of the FIG. 13A flash hider.
Figure 13C:
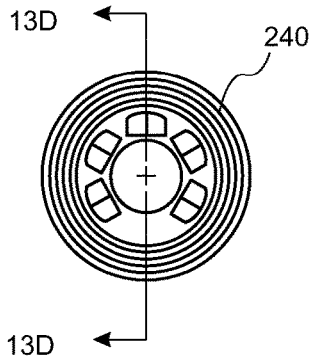
FIG. 13C is an end view of the FIG. 13A flash hider.
Figure 13D:
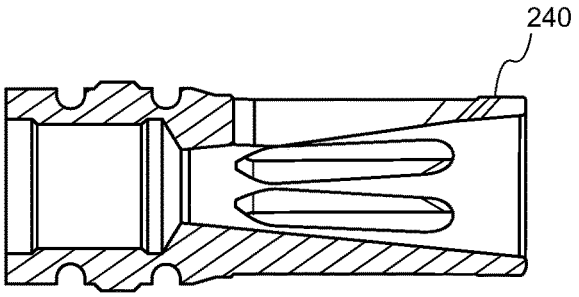
FIG. 13D is a cross sectional view of the FIG. 13A flash hider taken along line 13D-13D in FIG. 13C.
Figure 14B:
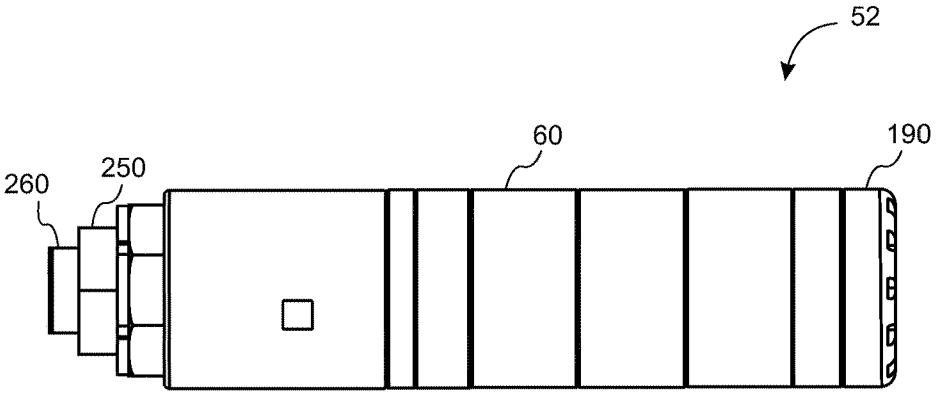
FIG. 14B is a side view of the FIG. 14A assembly.
Figure 14D:
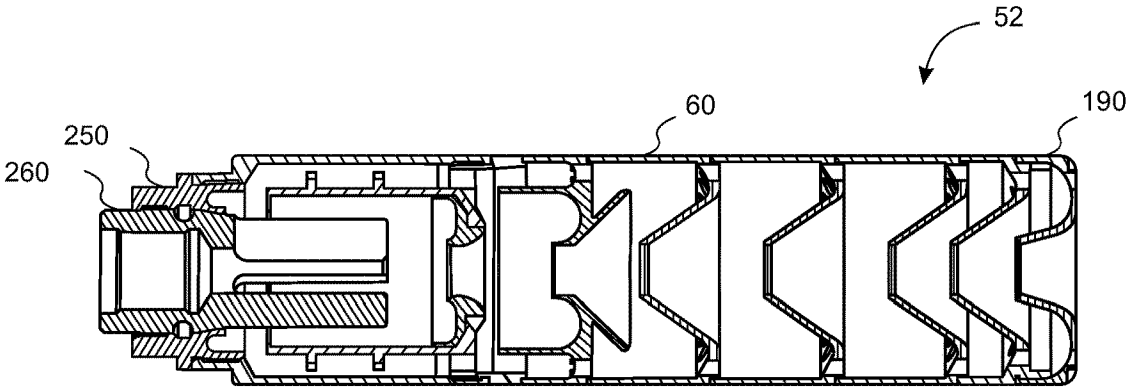
FIG. 14D is a cross sectional view of the FIG. 14A assembly taken along line 14D-14D in FIG. 14C.
Figure 14A:
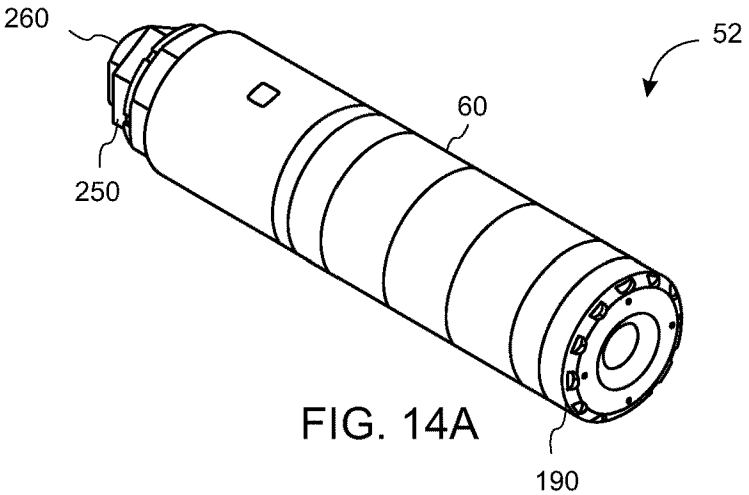
FIG. 14A is a perspective view of the FIG. 3A suppressor body assembly assembled with a second adaptor and a second flash hider.
Figure 14C:
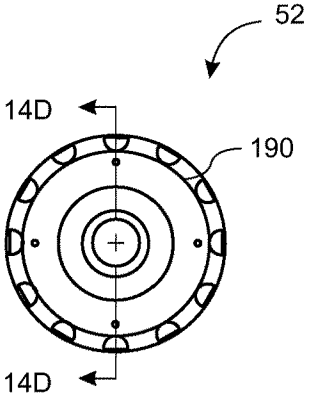
FIG. 14C is an end view of the FIG. 14A assembly.
Figure 15A:
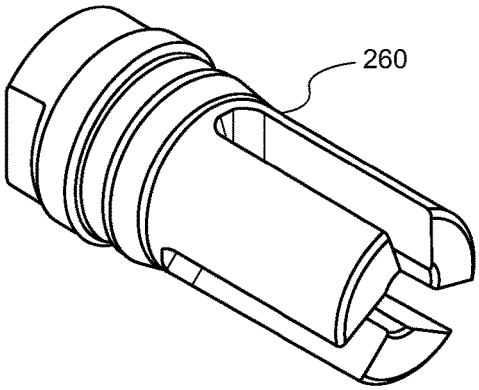
FIG. 15A is a perspective view of the FIG. 14A flash hider.
Figure 15B:
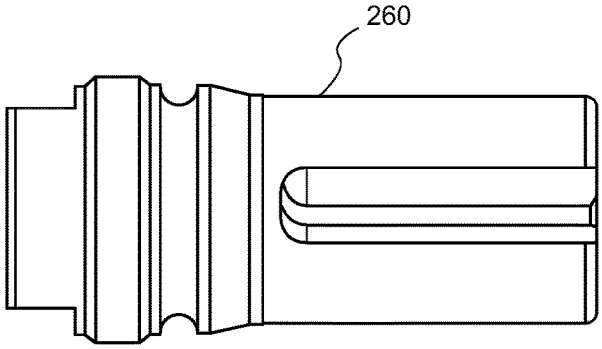
FIG. 15B is a side view of the FIG. 15A flash hider.
Figure 15C:
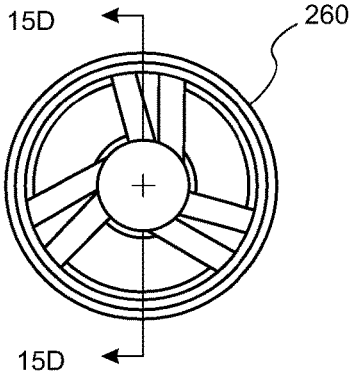
FIG. 15C is an end view of the FIG. 15A flash hider.
Figure 15D:
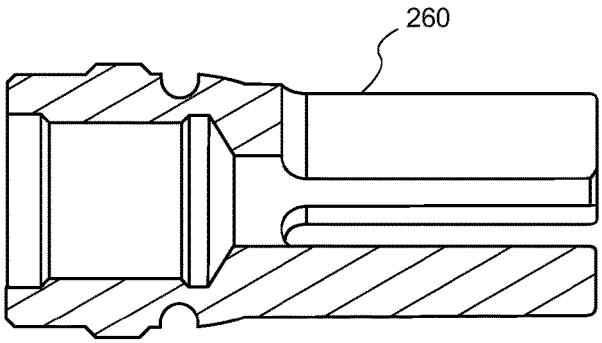
FIG. 15D is a cross sectional view of the FIG. 15A flash hider taken along line 15D-15D in FIG. 15C.
Figure 16B:
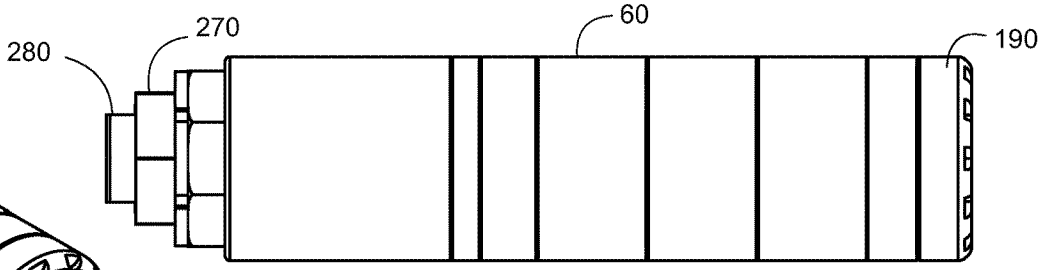
FIG. 16B is a side view of the FIG. 16A assembly.
Figure 16D:
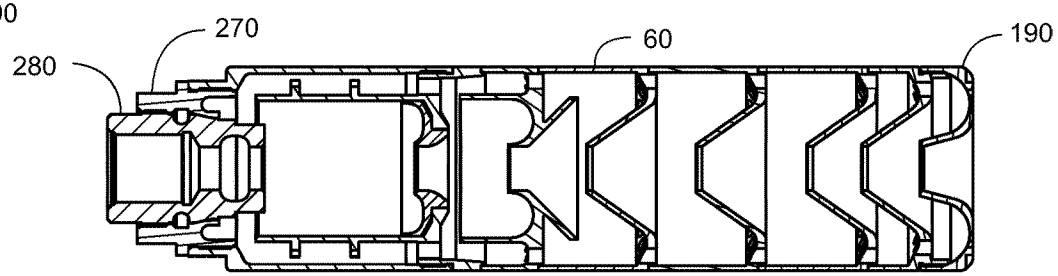
FIG. 16D is a cross sectional view of the FIG. 16A assembly taken along line 16D-16D in FIG. 16C.
Figure 16A:
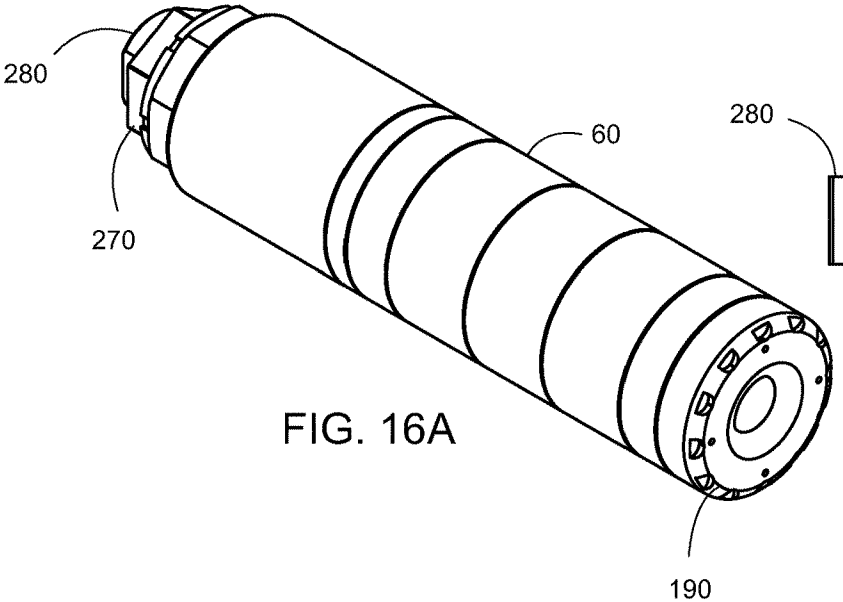
FIG. 16A is a perspective view of the FIG. 3A suppressor body assembly assembled with a third adaptor and a muzzle break.
Figure 16C:
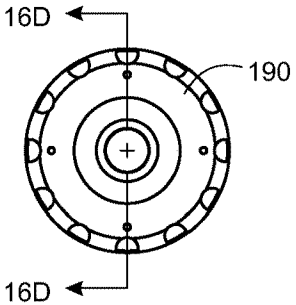
FIG. 16C is an end view of the FIG. 16A assembly.
Figure 17A:
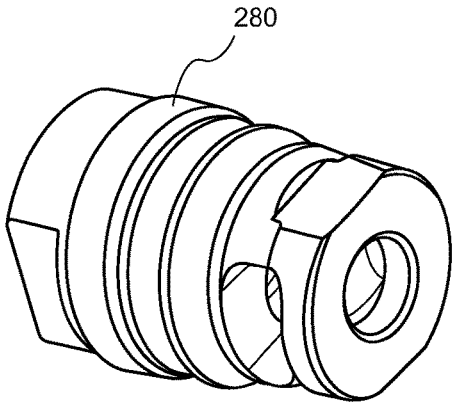
FIG. 17A is a perspective view of the FIG. 16A muzzle break.
Figure 17B:
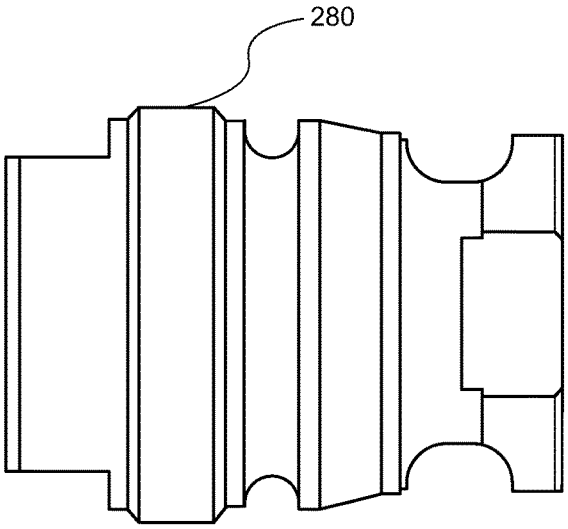
FIG. 17B is a side view of the FIG. 17A muzzle break.
Figure 17C:
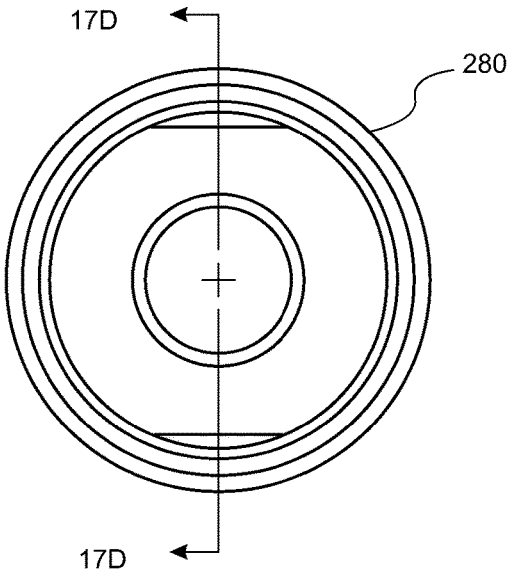
FIG. 17C is an end view of the FIG. 17A muzzle break.
Figure 17D:
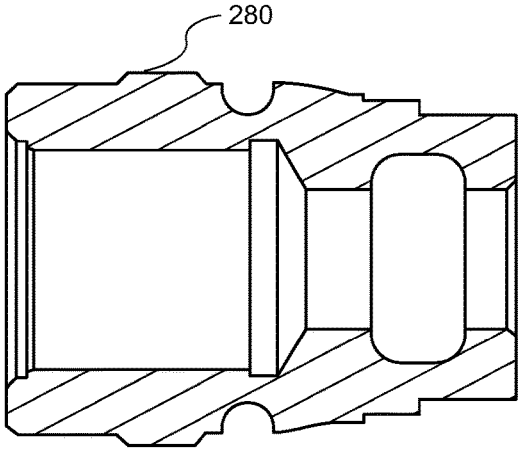
FIG. 17D is a cross sectional view of the FIG. 17A muzzle break taken along line 17D-17D in FIG. 17C.

As shown in FIG. 12D, the gap between flash hider 240 and rim 86 defines gas flow path FP1 that provides a route for gases vented out of flash hider 240 to expand laterally. Radiused surface 84 may assist in expanding vented gases omnidirectionally. Opening 110 defines gas flow path FP2 that provides a route for gases that have expanded omnidirectionally or otherwise pass through opening 110 to enter outer passage 94 to expand forward.

Also note that blast chamber 106 generally provides a relatively large internal volume positioned right at the exit from the barrel that allows initial gas expansion when a projectile is fired.

Gases exit baffle 70 through both central opening 108 and outer passage 94 at lateral passage 143 in baffle assembly 120. It should be noted that gas exiting through central opening 108 will be at a relative higher pressure than gas exiting through outer passage 94. In addition, gases passing through outer passage 94 have to transit a longer path than gases passing through central opening 108 so gases exit outer passage 94 generally later than gases pass through central opening 108 during a firing event.

Lateral passage 143 allows gas flow between inner passage 146 and outer passage 144. This is illustrated as flow path FP3 in FIG. 12D. Conical outlet 88 may help gases exiting central opening 108 to expand laterally in lateral passage 143 to outer passage 144. In addition, inner passage 146 defines a larger diameter relative to central opening 142, which may also help direct gases along flow path FP3 to outer passage 144. Gases exiting baffle assembly 120 must either pass through central opening 142 or one of ports 138. The relatively larger volume defined in inner passage 146 and outer passage 144 compared to the smaller exit openings (opening 142 and the plurality of ports 138) may further delay gases exiting.

Gases exiting opening 142 and the plurality of ports 138 enter annular opening 168 in baffle assembly 150 which permits gases to flow either to the plurality of ports 160 or to central opening 164. Conical outlet 134 may help gases exiting central opening 142 to expand laterally in annular opening 168 as shown as flow path FP4 in FIG. 12D. Again, the relatively larger volume defined by annular opening 168 relative to the small exit openings (central opening 164 and the plurality of ports 160) may further delay gases exiting. Conceal diffuser 162 may help gases exiting central opening 164 to expand laterally in the next baffle segment. In the illustrated embodiment, baffle assembly 150 is repeated three times. In other embodiments (not illustrated), additional or fewer baffle assemblies 150 can optionally be used depending on the desired characteristics of a suppressor. In generally, additional baffle assemblies will provide additional suppression of sound and flash at the cost of incremental reduced flowthrough rate. Fewer baffle assemblies will provide less suppression of sound and flash but will have incrementally increased flowthrough rate.

Gases exiting central opening 164 and the plurality of ports 160 in baffle assembly 150 enter annular opening 188 in baffle assembly 170 which permits gases to flow either to the plurality of ports 180 or to central opening 184. Conical diffuser 182 may help gases exiting central opening 184 to expand laterally.

Gasses exiting central 184 and the plurality of ports 180 in baffle assembly 170 exit central port 206. Conical outlet 204 may help gases exiting central port 206 to expand laterally after exiting suppressor 50. This may further reduce the emission of sound and/or light from suppressor 50 when a round is fired. Radiused surface 208 may redirect gasses exiting ports 180 omnidirectionally to central port 206.

Note that while the flow paths FP1, FP2, FP3, FP4 and FP5 are illustrated with a single headed arrows, gases can flow in either direction along the numerated flow paths FP1, FP2, FP3, FP4 and FP5.

The above suppressors are shown in scale drawings and are sized for use with .300 caliber slugs. However, the disclosed suppressors could be readily modified to work with other calibers of ammunition. For example, the disclosed suppressor system could be used in weapons chambers for many different calibers, including, but not limited to, 5.56 mm×45 mm, 9 mm, 10 mm, .40 S&W, .45 ACP, .300 AAC Blackout, 0.308 Winchester, 7.62 mm×51 mm and 50 BMG.

While the present disclosure has been illustrated and described in detail in the drawings and foregoing description, the same is to be considered as illustrative and not restrictive in character, it being understood that a preferred embodiment has been shown and described and that all changes, equivalents, and modifications that come within the spirit of the claimed invention defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The language used in the claims and the written description and in the above definitions is to only have its plain and ordinary meaning, except for terms explicitly defined above. Such plain and ordinary meaning is defined here as inclusive of all consistent dictionary definitions from the most recently published (on the filing date of this document) general purpose Merriam-Webster dictionary.

We claim:

1. A firearm suppressor configured to be mounted on a firearm, the firearm suppressor comprising:

a first baffle segment comprising a first cylindrical outer wall and a first conical baffle core, wherein said first conical baffle core defines a first central opening and wherein a longitudinal length of the first cylindrical outer wall is greater than a longitudinal length of the first conical baffle core;

a second baffle segment comprising a second cylindrical outer wall and a second conical baffle core, wherein said second conical baffle core defines a second central opening and wherein a longitudinal length of the second cylindrical outer wall is less than a longitudinal length of the second conical baffle core;

a third baffle segment comprising a third cylindrical outer wall; a first cylindrical inner wall concentrically arranged within the third outer wall; a first inner wall that defines a third central opening; and a plurality of protrusions extending radially outwardly from said first cylindrical inner wall;

wherein said third baffle segment defines a blast chamber within the first cylindrical inner wall that is free of obstructions and extends between a proximal end of said first cylindrical inner wall and said first inner wall; and wherein said third baffle segment defines a first outer flow passage between said third cylindrical outer wall and said first cylindrical inner wall.

2. The firearm suppressor of claim 1, wherein said first baffle segment defines a plurality of first ports positioned between said first cylindrical outer wall and said first conical baffle core and wherein said second baffle segment defines a plurality of second ports positioned between said second cylindrical outer wall and said second conical baffle core.

3. The firearm suppressor of claim 1, wherein said first baffle segment is welded to said second baffle segment with the first and second central openings longitudinally aligned.

4. The firearm suppressor of claim 1, further comprising a shoulder that extends between said third cylindrical outer wall and said first cylindrical inner wall.

5. The firearm suppressor of claim 4, wherein said shoulder defines a plurality of third ports positioned between said third cylindrical outer wall and said first cylindrical inner wall.

6. The firearm suppressor of claim 4, wherein said third cylindrical outer wall is welded to said shoulder.

7. The firearm suppressor of claim 1, further comprising a first conical outlet extending from said third central opening.

8. The firearm suppressor of claim 1, further comprising an adaptor configured as a quick connect faster for use with a flash hider or a muzzle brake.

9. The firearm suppressor of claim 1, further comprising an end cap comprising an end wall that defines an exit central opening.

10. The firearm suppressor of claim 9, wherein said end wall defines a plurality of exit ports positioned radially around the exit central opening.

11. The firearm suppressor of claim 9, wherein said end wall defines a conical exit extending distally from the exit central opening.

12. A firearm suppressor configured to be mounted on a firearm, the firearm suppressor comprising:

a first baffle segment comprising a first cylindrical outer wall and a first conical baffle core, wherein said first conical baffle core defines a first central opening and wherein a longitudinal length of the first cylindrical outer wall is greater than a longitudinal length of the first conical baffle core;

a second baffle segment comprising a second cylindrical outer wall and a second conical baffle core, wherein said second conical baffle core defines a second central opening and wherein a longitudinal length of the second cylindrical outer wall is less than a longitudinal length of the second conical baffle core;

a third baffle segment comprising a third cylindrical outer wall; a first cylindrical inner wall concentrically arranged within the third outer wall; a first inner wall that defines a third central opening;

wherein said third baffle segment defines a blast chamber within the first cylindrical inner wall that is free of obstructions and extends between a proximal end of said first cylindrical inner wall and said first inner wall; and wherein said third baffle segment defines a first outer flow passage between said third cylindrical outer wall and said first cylindrical inner wall; and a fourth baffle segment comprising: a fourth cylindrical outer wall; a second inner wall that defines a fourth central opening; a second cylindrical inner wall extending proximally from said second inner wall; and a second conical outlet that extends from the fourth central opening to distally from the second inner wall.

13. The firearm suppressor of claim 12, further comprising a cylindrical projection that extends proximally from said second inner wall that defines said fourth central opening.

14. The firearm suppressor of claim 13, wherein the second inner wall defines a radiused transition between said cylindrical projection and said second cylindrical inner wall.

15. The firearm suppressor of claim 12, wherein said second inner wall defines a plurality of fourth ports positioned between said fourth cylindrical outer wall and said second cylindrical inner wall.

16. The firearm suppressor of claim 12, wherein a longitudinal extension of said second cylindrical inner wall proximally from said second inner wall is greater than a longitudinal extension of said fourth cylindrical outer wall.

17. The firearm suppressor of claim 12, wherein said second conical outlet extends distally beyond said second inner wall.

18. A firearm suppressor configured to be mounted on a firearm, the firearm suppressor comprising:

a first baffle segment comprising a first cylindrical outer wall; a first cylindrical inner wall concentrically arranged within the first outer wall; a first inner wall that defines a first central opening; and a plurality of protrusions extending radially outwardly from said first cylindrical inner wall;

wherein said first baffle segment defines a blast chamber within the first cylindrical inner wall that is free of obstructions and extends between a proximal end of said first cylindrical inner wall and said first inner wall; and wherein said first baffle segment defines a first outer flow passage between said first cylindrical outer wall and said first cylindrical inner wall.

19. The firearm suppressor of claim 18, further comprising: a second baffle segment comprising: a second cylindrical outer wall; a second inner wall that defines a second central opening; a second cylindrical inner wall extending proximally from said second inner wall; and a second conical outlet that extends from the second central opening to distally from the second inner wall.

20. The firearm suppressor of claim 19, further comprising a cylindrical projection that extends proximally from said second inner wall that defines said second central opening, wherein said second baffle segment defines a second outer flow passage between said second cylindrical outer wall and said cylindrical projection.

21. The firearm suppressor of claim 20, wherein the second baffle segment is coupled to the first baffle segment with the first and second central openings longitudinally aligned, wherein the first and second baffle segments define a lateral passage therebetween that fluidly couples the first central opening to both the first and second outer flow passages.

22. The firearm suppressor of claim 20, further comprising an adaptor configured as a quick connect faster for use with a flash hider or a muzzle brake, wherein the blast chamber is adapted to receive a portion of the flash hinder or muzzle brake.

* * * * *